United States Patent [19]

Christman

[11] Patent Number: 4,703,712

[45] Date of Patent: Nov. 3, 1987

[54] MANUAL SLIDE SELECTOR MECHANISM

[76] Inventor: Marvin Christman, 4350-53rd Ave. NE., Seattle, Wash. 98005

[21] Appl. No.: 899,532

[22] Filed: Aug. 22, 1986

[51] Int. Cl.[4] ..... G09F 9/00; H01H 3/50; H01H 15/00

[52] U.S. Cl. ..... 116/324; 116/321; 200/16 R

[58] Field of Search ..... 200/16 R, 5 A, 6 B, 200/6 R, 329, 339, 340; 116/321–324

[56] References Cited

U.S. PATENT DOCUMENTS

| | | | |
|---|---|---|---|
| 3,485,204 | 12/1969 | Christman | 200/16 R X |
| 3,862,382 | 1/1975 | Glaister et al. | 200/5 A |
| 4,324,956 | 4/1982 | Sakakino et al. | 200/6 B X |

*Primary Examiner*—J. R. Scott

*Attorney, Agent, or Firm*—Robert W. Beach; Ward Brown

[57] ABSTRACT

A manual selector includes a frame fixedly seated on a base forming oppositely opening internal grooves. A slide is slideable lengthwise in the grooves between discrete selective positions. A position identifying colored surface of the base is visible through a slot in the top of the frame for distinguishing between the selector positions. The slide includes a plurality of feet at opposite sides of the slide. The feet contact the colored base surface only at the opposite margins of the surface. A slide-locating assembly includes an interengageable member carried by the slide and a plurality of cooperating interengageable members carried by the frame. The engagement of the slide interengageable member with one of the frame interengageable members defines one of plurality of selective positions.

3 Claims, 9 Drawing Figures

Fig. 3.
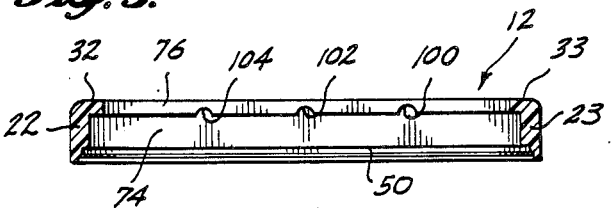
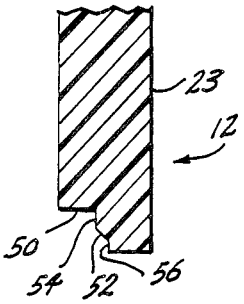
Fig. 4.
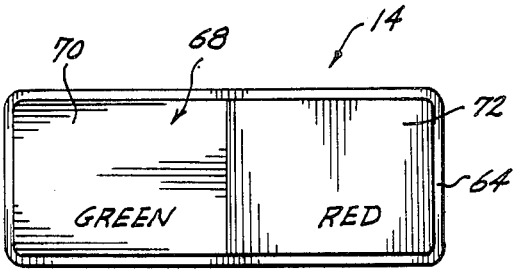
Fig. 5.
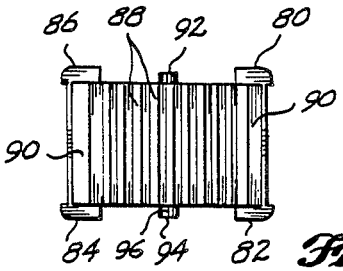
Fig. 7.
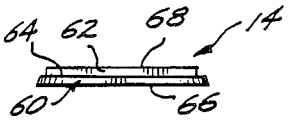
Fig. 6.
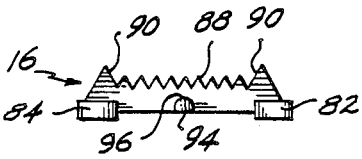
Fig. 8.
Fig. 9.
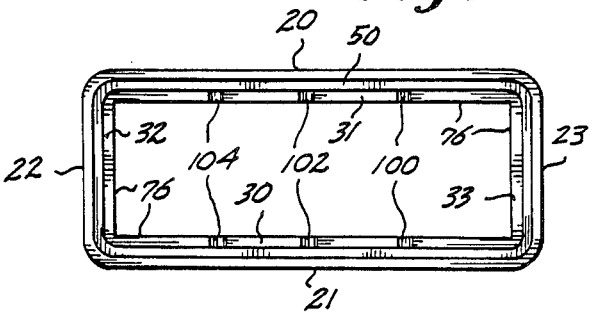

MANUAL SLIDE SELECTOR MECHANISM

TECHNICAL FIELD

This invention relates to indicating selector mechanisms. More particularly, this invention relates to a manual slide selector.

BACKGROUND OF THE INVENTION

The manual selector of this invention is an improvement on the indicating slide mechanism described in U.S. Pat. No. 3,485,204 and shown in FIG. 10. The original indicating slide mechanism uses an indicia strip having a two-colored painted surface for easy identification of three selector positions. Because the indicia strip is a separate piece which fits between the mounting and the slide, a precise and snug fit is difficult to achieve and retain.

The original indicating slide mechanism uses a two-piece mounting held together by an adhesive backing, often resulting in imprecise coupling of the mounting. The indicia strip fits in a groove within each piece of the mounting. While attempting to fit the strip into the groove, however, the strip is frequently bent, resulting in a defective indicating slide mechanism.

The original indicating slide mechanism mounting and slide are made from an acetyl plastic compound which tends to shrink over time. As a result, the slide develops a looser fit within the slots of the mounting and can move unintentionally away from the intended selected position.

DISCLOSURE OF THE INVENTION

An object of this invention is to provide an easy to use, easy to assemble manual slide selector.

Another object of this invention is to provide a manual selector that reliably indicates each selector position.

A still further object of this invention is to provide a manual selector having a slide that operates smoothly with little friction.

These and other objects of the invention are provided by a manual selector having a one-piece molded frame and a baseplate having a hot stamped colored surface assembled to form a housing. The slide is improved so that the slide makes only minimal contact with the baseplate along opposite edges of the painted surface. The baseplate and frame are connected to define more precisely a dimensioned guide groove for the slide which enables use of a more rigid slide.

BRIEF DESCRIPTION OF THE DRAWINGS

FIG. 3 is a longitudinal section through the frame.

FIG. 4 is a detail section of an edge portion of the frame to be connected to the base.

FIG. 5 is a top plan of the baseplate.

FIG. 6 is an end elevation of the baseplate.

FIG. 7 is a top plan of the slide.

FIG. 8 is a side elevation of the slide.

FIG. 9 is a bottom plan of the frame.

DETAILED DESCRIPTION

Figure 1:
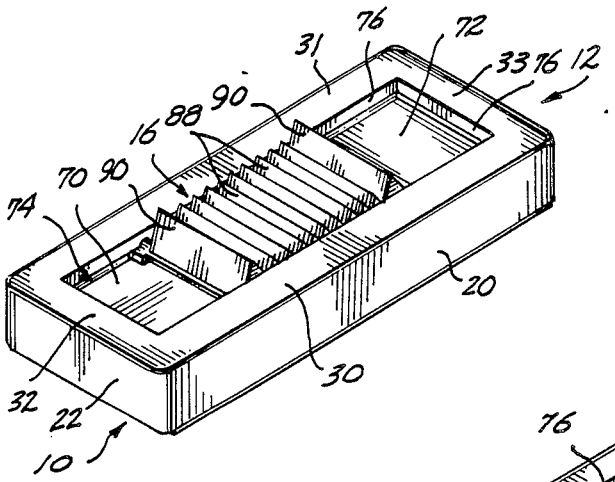
FIG. 1 is a top isometric view of the manual selector.
Figure 2:
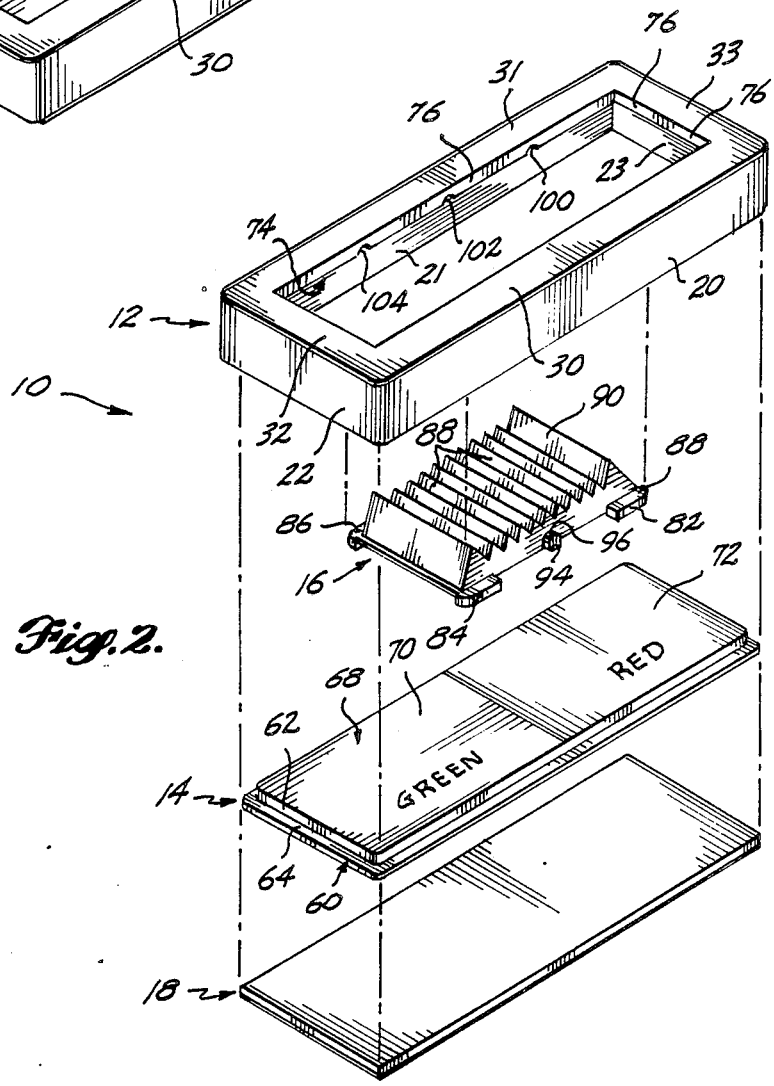
FIG. 2 is a top exploded isometric view of the manual selector.

The manual selector 10, shown in FIGS. 1 and 2, comprises a frame 12, a baseplate 14, a slide 16, and an adhesive backing strip 18. The frame and baseplate can be assembled to form a housing. All of the selector components are composed of polystyrene material and manufactured by a conventional molding process.

The frame 12 is a one-piece frame of generally rectangular shape, having an open bottom, four walls 20–23, and four top inwardly projecting flanges 30–33. The thickness of the frame is less than its width and less than its length. Opposite generally rectangular longitudinal side walls 20 and 21 and opposite generally rectangular end walls 22 and 23 comprise the four walls of the frame connected at the frame corners.

Opposite inner side flanges 30 and 31 and opposite inner end flanges 32 and 33 connected at the frame corners comprise the four top walls of the frame. The four top wall flanges are in the same plane and form an elongated slot between their interior edges. The top inner flanges 30–33 and the walls 20–23 form the one-piece generally rectangular frame 12.

To facilitate attachment of the baseplate to frame 12, the contour of the frame bottom edge shown in FIG. 4 matches the shape of the edge of the baseplate 14 shown in FIG. 6. The bottom edge of each wall has a first ledge 50 and a second ledge 52. The walls 54, 56 are generally perpendicular to the first ledge 50.

The one-piece baseplate 14 shown in FIGS. 5 and 6 has a generally rectangular outer part 60 and a smaller generally rectangular inner part 62 forming a rim 64 0.03 inch (0.076 cm) wide. When the baseplate 14 is attached to the lower edges of the frame walls 20–23, the margin of the base part 60 and flange 64 engage the ledges 50 and 52, respectively, of each frame wall and the base edge portions will be within 0.005 inch (0.0127 cm) of the inner frame perimeter wall 54 and of the outer frame perimeter wall 56. The bottom of baseplate 14 is thus generally parallel to the plane of the frame top flanges 30–33 and generally perpendicular to the frame walls 20–23. The base 60 has a lower surface 66 to which a double-sided adhesive strip 18 may be attached.

The inner part 62 of the base has a colored top surface 68. For a three-position manual selector such surface has a first area 70 painted green and a second area 72 painted red, although other colors may be used. One method used to paint the colored areas is a conventional hot stamping method which provides a durable high gloss finish.

Referring again to FIG. 3, the baseplate 14 and the longitudinal inwardly projecting top wall side flanges 30 and 31 of frame 12 define oppositely opening guide grooves 74 beneath such flanges. The elongated slot formed between the inner edge of the four top flanges 30–33 is bordered by four slot walls 76. The guide grooves 74 are bordered by the undercut surfaces of the opposite top flanges 30 and 31, side walls 20 and 21 and baseplate 14.

Referring to FIGS. 1, 2, 7 and 8, a one-piece slide member 16 moves within the housing and a portion of such slide protrudes upward through the slot defined by slot walls 76. Referring to FIG. 8, the slide comprises a generally rectangular body having four small feet 80, 82, 84, 86 integrated therewith and located one at each corner of the slide, respectively. These feet have a length lengthwise of the slide which is a small fraction, such as about one fifth, of the length of the slide, and a width transversely of the slide which is a small fraction, such as about one sixth, of the slide body width. Two feet 82 and 84 project laterally beyond a first elongated edge of the slide body and the other two feet 80 and 86 project laterally beyond the second elongated edge of the slide body.

Each foot has a height slightly less than the height of a guide groove 74, where the groove height is defined by the distance between surface 68 and the underside of each top flange 30 and 31. An upper surface of each foot adjacent to the slide body is normally positioned within a guide groove 74 beneath a flange 30 or 31.

Referring to FIG. 8, the slide body has a finger-engageable friction surface formed by a series or ridges 88 bordered by a pair of higher ridges 90 at opposite ends of such ridge series. Each ridge within the series of ridges 88 is approximately 0.04 inch (0.102 cm) in height and is spaced approximately 0.03 inch (0.076 cm) from the adjacent ridges, measured at the tips of the ridges. A cantilever pin 92 projects from the central portion of one elongated edge of the slide body substantially midway between feet 80 and 86 and a cantilever pin 94 projects from the central portion of the other elongated edge of the slide body substantially midway between feet 82 and 84. The pins 92 and 94 protrude out from the slide body for a distance less than the width of each foot lateral projection.

A contact surface 96 of each pin 92 and 94 is higher than the upper surface of the two feet on the corresponding edge of the slide. The contact surface 96 for each pin 92 and 94, respectively, engages one of a pair of indentations in the undersides of the top flanges 30 and 31. For a three-position manual selector three pairs of indentations 100, 102, 104, as shown in FIGS. 3 and 9, define three selective positions.

In operation, slide 16 moves longitudinally within the hollow of the housing between distinct selective positions. The bottoms of the feet rest and slide on the opposite longitudinal margins of surface 68 (FIG. 2) of baseplate 14 and the upper sides can engage the undersides of the top flanges 30 and 31. The small contact area of the bottoms of the feet 80, 82, 84 and 86 with the base upper surface 68 provides smooth easy sliding of the slide over the base between the selective positions with little friction.

During each sliding, pins 92 and 94 engage into one of the three groove pairs 100, 102, 104. By pressing a finger against the ridges 88, 90, the feet 80, 82, 84 and 86 of slide 16 are pushed against baseplate 14 to disengage the pins 92 and 94 from a groove pair. The slide 16 then may be moved selectively to another selected position where the contact surfaces 96 of pins 92 and 94 engage a different groove pair. One groove pair 100 defines a first selective position where the green area 70 of surface 68 is exposed. A second groove pair 102 defines a second selective position where equal portions of the green area 70 and of the red area 72 of surface 68 are exposed. A third groove pair 104 defines a third selective position where the red area 72 of surface 68 is exposed.

I claim:

1. A manual selector including a rectangular frame having a thickness less than its length, having an open bottom and having a top wall with two longitudinal inwardly projecting opposite side flanges spaced apart for forming an elongated slot therebetween, at least one of such flanges having a plurality of indentations in its underside spaced lengthwise thereof, a base closing the bottom of the frame and spaced from the underside of the frame top wall for forming a housing having oppositely opening guide grooves between the base and the frame top wall flanges, and a rectangular slide received in the housing and having an upwardly projecting portion receivable in the frame top wall slot for movement lengthwise thereof, the improvement comprising the rectangular slide having four feet, one beneath each corner thereof, each foot having a length a small fraction of the length of the slide so that said feet are widely spaced apart both longitudinally and transversely of the slide and each foot projecting laterally from the slide into a guide groove of the housing so that said feet bear substantially only on the longitudinal margins of the base beneath the frame top wall flanges, and a cantilever pin projecting from one side of the slide beneath the top wall flange having indentations in its underside and engageable selectively with such indentations to hold the slide in different selected positions lengthwise of the frame top wall slot corresponding to the locations of such respective indentations.

2. The selector defined in claim 1, in which the upper side of the slide has a pair of ridges spaced apart a distance sufficient for reception of a fingertip therebetween and such ridges project upward from the slide a substantial distance above the highest portion of the slide surface between said ridges of said pair.

3. The selector defined in claim 2, in which the upper surface of the slide bears a plurality of parallel ridges between the ridges of the pair.

* * * * *